US007909643B2

(12) United States Patent
Pepe et al.

(10) Patent No.: US 7,909,643 B2
(45) Date of Patent: Mar. 22, 2011

(54) CASSETTE FOR A CABLE INTERCONNECT SYSTEM

(75) Inventors: Paul John Pepe, Clemmons, NC (US); Sheldon Easton Muir, Whitsett, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/394,816

(22) Filed: Feb. 27, 2009

(65) Prior Publication Data

US 2010/0221931 A1 Sep. 2, 2010

(51) Int. Cl.
*H01R 13/60* (2006.01)

(52) U.S. Cl. ..... 439/540.1

(58) Field of Classification Search ..... 439/676, 439/540.1, 541.5
See application file for complete search history.

(56) References Cited

U.S. PATENT DOCUMENTS

| | | | | |
|---|---|---|---|---|
| 3,945,706 | A * | 3/1976 | Steiner et al. | 439/491 |
| 5,178,554 | A | 1/1993 | Siemon et al. | |
| 5,217,394 | A | 6/1993 | Ho | |
| 5,509,812 | A | 4/1996 | Comerci et al. | |
| 5,562,493 | A | 10/1996 | Ferrill et al. | |
| 5,639,261 | A | 6/1997 | Rutkowski et al. | |
| 5,647,765 | A | 7/1997 | Haas et al. | |
| 5,700,167 | A * | 12/1997 | Pharney et al. | 439/676 |
| 5,735,708 | A * | 4/1998 | Arnett et al. | 439/491 |
| 5,735,712 | A | 4/1998 | Haas et al. | |
| 5,741,153 | A * | 4/1998 | Schwer | 439/491 |
| 5,800,207 | A | 9/1998 | Hsu et al. | |
| 5,924,890 | A * | 7/1999 | Morin et al. | 439/490 |
| 6,053,764 | A * | 4/2000 | Curry et al. | 439/676 |
| 6,066,001 | A | 5/2000 | Liptak et al. | |
| 6,074,251 | A | 6/2000 | Edgerly et al. | |
| 6,120,318 | A | 9/2000 | Reed et al. | |
| 6,132,260 | A | 10/2000 | Wu | |
| 6,168,474 | B1 * | 1/2001 | German et al. | 439/676 |
| 6,222,908 | B1 | 4/2001 | Bartolutti et al. | |
| 6,227,911 | B1 | 5/2001 | Boutros et al. | |
| 6,269,008 | B1 | 7/2001 | Hsu | |
| 6,302,742 | B1 | 10/2001 | Berst et al. | |
| 6,319,047 | B1 * | 11/2001 | Kang | 439/676 |
| 6,364,707 | B1 | 4/2002 | Wang | |

(Continued)

FOREIGN PATENT DOCUMENTS

EP 1 458 062 A2 9/2004

(Continued)

OTHER PUBLICATIONS

European Search Report Application No. 10 15 2335, International Filing Date Jan. 2, 2010.

(Continued)

*Primary Examiner* — Briggitte R Hammond

(57) ABSTRACT

A cassette includes a housing having a front and a rear. The housing has a plurality of plug cavities open at the front for receiving plugs therein, and the housing has a rear chamber open to the plug cavities. The cassette also includes a contact subassembly having a circuit board and a plurality of contacts arranged in contact sets coupled to the circuit board. Each contact set is configured to mate with a corresponding plug, where the contact subassembly is loaded into the rear chamber such that the contact sets are received in different corresponding plug cavities. The circuit board is oriented generally parallel to the front of the housing when the contact subassembly is loaded into the rear chamber.

21 Claims, 10 Drawing Sheets

U.S. PATENT DOCUMENTS

| | | | | |
|---|---|---|---|---|
| 6,364,713 | B1 | 4/2002 | Kuo | |
| 6,540,564 | B1 | 4/2003 | Ko | |
| 6,608,764 | B2 | 8/2003 | Clark et al. | |
| 6,612,867 | B1 | 9/2003 | Wu | |
| 6,626,697 | B1 | 9/2003 | Martin et al. | |
| 6,655,988 | B1 | 12/2003 | Simmons et al. | |
| 6,780,035 | B2 | 8/2004 | Bohbot | |
| 6,786,772 | B1 * | 9/2004 | Liu | 439/541.5 |
| 6,802,735 | B2 | 10/2004 | Pepe et al. | |
| 6,976,867 | B2 | 12/2005 | Navarro et al. | |
| 6,988,914 | B2 | 1/2006 | Pepe | |
| 7,033,210 | B1 | 4/2006 | Laurer et al. | |
| 7,077,707 | B2 | 7/2006 | Hyland et al. | |
| 7,140,924 | B2 * | 11/2006 | Redfield et al. | 439/676 |
| 7,300,307 | B2 | 11/2007 | Murr | |
| 7,357,675 | B2 | 4/2008 | Barringer et al. | |
| 7,367,850 | B1 | 5/2008 | Chang | |
| 7,384,310 | B2 * | 6/2008 | Hu et al. | 439/541.5 |
| 7,530,854 | B2 * | 5/2009 | Aekins | 439/676 |
| 2003/0095395 | A1 | 5/2003 | Clark et al. | |
| 2004/0209515 | A1 * | 10/2004 | Caveney et al. | 439/540.1 |
| 2004/0229501 | A1 | 11/2004 | Caveney et al. | |
| 2004/0246693 | A1 | 12/2004 | Lloyd et al. | |
| 2005/0136747 | A1 | 6/2005 | Caveney et al. | |
| 2005/0164548 | A1 | 7/2005 | Spears et al. | |
| 2005/0185912 | A1 | 8/2005 | Levesque | |
| 2005/0282432 | A1 | 12/2005 | Murr et al. | |
| 2005/0282441 | A1 | 12/2005 | Murr et al. | |
| 2006/0246784 | A1 | 11/2006 | Aekins et al. | |
| 2007/0066141 | A1 | 3/2007 | Shu et al. | |
| 2007/0032129 | A1 | 5/2007 | Kim et al. | |
| 2008/0090461 | A1 | 4/2008 | Pepe et al. | |

FOREIGN PATENT DOCUMENTS

| | | |
|---|---|---|
| GB | 2 339 090 A | 1/2000 |
| WO | WO 2004/091055 | 10/2004 |
| WO | WO 2005/053111 | 6/2005 |
| WO | WO 2006/063023 | 6/2006 |
| WO | WO 2007/044855 | 4/2007 |

OTHER PUBLICATIONS

International Search Report, International Application No. PCT/US2010/000564, International Filing Date Feb. 24, 2010, 3 pgs.

* cited by examiner

CASSETTE FOR A CABLE INTERCONNECT SYSTEM

CROSS REFERENCE TO RELATED APPLICATIONS

This application related to copending U.S. patent application Ser. No. 12/394,912 titled "CASSETTE HAVING INTERCHANGEABLE REAR MATING CONNECTORS", and filed Feb. 27, 2009, U.S. patent application Ser. No. 12/394,987 titled "SHIELDED CASSETTE FOR A CABLE INTERCONNECT SYSTEM", and filed Feb. 27, 2009, U.S. patent application Ser. No. 12/395,049 titled "CASSETTE FOR USE WITHIN A CONNECTIVITY MANAGEMENT SYSTEM", and filed Feb. 27, 2009, and U.S. patent application Ser. No. 12/395,144 titled "CASSETTE WITH LOCKING FEATURE", and filed Feb. 27, 2009, the subject matter of each of which is herein incorporated by reference in their entirety.

BACKGROUND OF THE INVENTION

The subject matter herein relates generally to cable interconnect systems, and more particularly, to cassettes that have an array of jacks for interlacing with modular plugs.

Known connector assemblies exist having multiple receptacle connectors in a common housing, which provide a compact arrangement of such receptacle connectors. Such, a connector assembly is useful to provide multiple connection ports. Accordingly, such a connector assembly is referred to as a multiple port connector assembly. The receptacle connectors may be in the form of RJ-45 type modular jacks that establish mating connections with corresponding RJ-45 modular plugs. The receptacle connectors, each have electrical terminals arranged in a terminal array, and have plug receiving cavities.

One application for such multi-port connector assemblies is in the field of electronic networks, where desktops or other equipment are interconnected to servers or other network components by way of sophisticated cabling. Such networks may have a variety of data transmission mediums including coaxial cable, fiber optic cable and copper cable. One such network is an Ethernet network, which is subject to various electrical standards, such as IEEE 802.3 and others. Such networks have the requirement to provide a high number of connections, yet optimally requires little space in which to accommodate the connections. Another application for such connector assemblies is in the field of telephony, wherein the connector ports allow for connection with a telephone switching network of a telephone service provider, such as a regional telephone company or national telephone company.

One type of connector assembly is known as a stacked jack connector assembly, where the housing has receptacles one above the other, forming a plurality of arrays in stacked arrangement, so-called "stocked jack" arrangements. One example of a stacked jack type of connector assembly is disclosed in U.S. Pat. No. 6,655,988, assigned to Tyco Electronics Corporation, which discloses an insulative housing having two rows of receptacles that provide an interface port for modular plugs. The receptacles are arranged side-by-side in an upper row and side-by-side in a lower row in a common housing, which advantageously doubles the number of receptacles without having to increase the length of the housing. Contact modules having contacts for both upper receptacles and lower receptacles are loaded into the insulative housing. The insulative housing and each of the contact modules are simultaneously mounted to a circuit board, and an outer shield surrounds the unit. The stacked jack connector assembly may then be mounted to a corresponding network component, such as a panel. Stacked jacks have the advantage of coupling a plurality of receptacles within a network at the same time. However, stacked jacks are typically complex to manufacture, as the stacked jacks require many special features within the insulated housing. Additionally, due to the required geometry, the receptacles within the upper row have contacts that are longer than the contacts of the receptacles in the lower row, which changes electrical characteristics of the receptacles. For example, since the receptacles in the upper row, are farther away from the circuit board than the receptacles in the lower row, the contact of the upper receptacles have a longer contact length between a mating interface of the contacts and the circuit board, which may cause signal degradation.

Another type of connector assembly includes a plurality of individual modular jacks that are mounted within a housing to forth an interface connector. Each modular jack includes a jack housing defining a plug cavity and a plurality of contacts within the plug cavity. The modular jack is terminated to a cable and separately coupled to the housing. The interface connector, including a number of the modular jacks, is mounted to a corresponding network component, such as a panel. While interface connectors have the advantage of coupling a plurality of modular jacks within a network component at the same time, the interface connectors have the problem of having reduced density. The density problem arises from each modular jack having a separate jack housing, which, may be bulky, and which have a latch, typically on top of the modular jack, that latches to a latching surface on the connector assembly housing. Furthermore, additional space is required to accommodate pivoting the modular jack during loading and unloading each jack into the connector assembly housing. Interface connectors also suffer from problems associated with cable density and cable management. As such, interface connectors are not typically arranged in a stacked configuration.

At least one of the problems with known connector assemblies is that today's networks require higher numbers of connections in limited spaces to accommodate increasingly complex networks.

BRIEF DESCRIPTION OF THE INVENTION

In one embodiment, a cassette is provided mat includes a housing having a front and a rear. The housing has a plurality of plug cavities open at the front for receiving plugs therein, and the housing has a rear chamber open to the plug cavities. The cassette also includes a contact subassembly having a circuit board and a plurality of contacts arranged in contact sets coupled to the circuit board. Each contact set is configured to mate with a corresponding plug, where the contact subassembly is loaded into the rear chamber such that the contact sets are received in different corresponding plug cavities. The circuit board is oriented generally parallel to the front of the housing when the contact subassembly is loaded into the rear chamber.

Optionally, the circuit board may be positioned behind each of the contact sets generally between the contact sets and the rear of the housing. The contacts may extend into plug cavities generally along a plug axis extending in a direction in which the plug is loaded into the plug cavities. The circuit board may be oriented generally perpendicular to the plug axis. The circuit hoard may have a first side and a second side and the contacts may extend from the first side. The contact subassembly may have at least one electrical connector mounted to the second side of the circuit board that is electrically connected to the contacts of one or more of the contact sets. The contact subassembly may include a plurality of contact supports extending from the circuit board in close proximity to respective contact sets, where each contact support is configured to support the contacts of the corresponding contact set. The contact supports may be received in different plug cavities when the contact subassembly is loaded into the rear chamber. Optionally, each contact support may cooperate with walls of the housing defining the corresponding plug cavity to farm a box-like cavity around the contacts, where the contact support defines one side of the box-like cavity. The cassette may also include a rear mating connector generally opposite the front where the rear mating connector is electrically connected to the contacts. The rear mating connector may communicate with contacts of more than one contact set. Optionally, the housing, may have a tongue extending between first and second rows of plug cavities, where the tongue is positioned between contacts of different contact sets. The housing may have a plurality of walls positioned between adjacent plug cavities, where the walls are configured to engage the plugs when the plugs are loaded into the plug cavities.

In another embodiment, a cassette is provided that includes a housing having a front and a rear. The housing has a plurality of plug cavities arranged in a stacked configuration in a first row and a second row. The plug cavities are open at the front for receiving plugs therein, and the housing has a rear chamber open to the plug cavities. The cassette also includes a contact subassembly having a circuit board and a plurality of contacts arranged in contact sets coupled to the circuit board. Each contact set is configured to mate with a corresponding plug, and the contact subassembly is loaded into the rear chamber such that the contact sets are received in different corresponding plug cavities. The contacts of the contact sets received in the first row of plug cavities have substantially similar contact lengths as the contacts of the contact sets received in the second row of plug cavities.

In a further embodiment, a cable interconnect system is provided that includes a panel having a module opening, and a cassette received in the module opening. The cassette has a housing having a front and a rear. The housing has a plurality of plug cavities that are open at the front for receiving plugs therein. The housing has a rear chamber that is open to the plug cavities. The cassette also includes a contact subassembly having a circuit board and a plurality of contacts arranged in contact sets coupled to the circuit board. Each contact set is configured to mate with a corresponding plug. The contact subassembly is loaded into the rear chamber such that the contact sets are received in different corresponding plug cavities. The circuit board is oriented generally parallel to the front of the housing when the contact subassembly is loaded into the rear chamber.

DETAILED DESCRIPTION OF THE INVENTION

Figure 1:
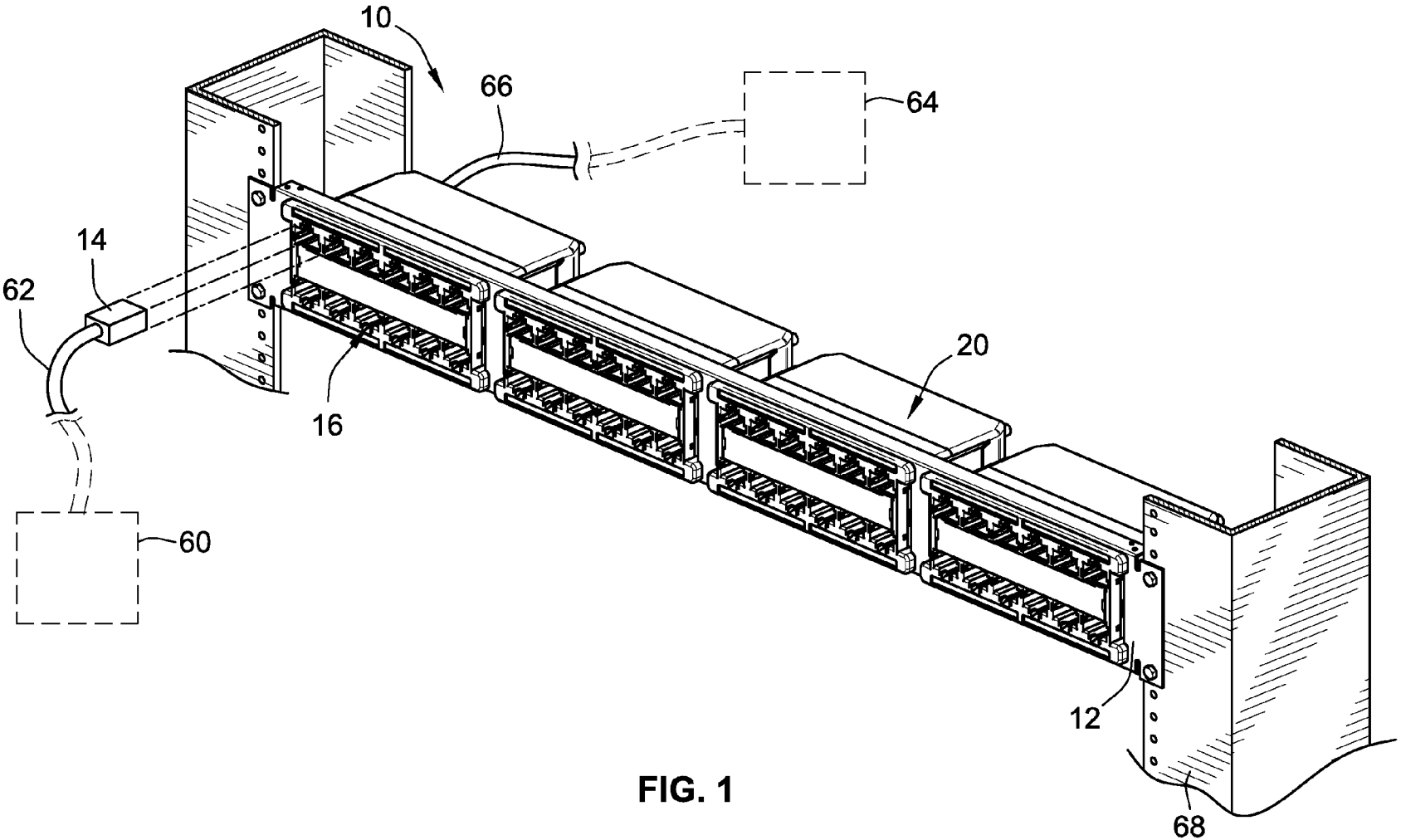
FIG. 1 is a front perspective view of a portion of a cable interconnect system incorporating a plurality of cassettes mounted to the panel with a modular plug connected thereto.

FIG. 1 is a front perspective view of a portion of a cable interconnect system 10 illustrating a panel 12 and a plurality of cassettes 20 mounted to the panel 12 and a modular plug 14 connected thereto. The cassette 20 comprises an array of receptacles 16 for accepting or receiving the modular plug 14.

The cable interconnect system 10 is utilized to interconnect various equipment, components and/or devices to one another. FIG. 1 schematically illustrates a first device 60 connected to the cassette 20 via a cable 62. The modular plug 14 is attached to the end of the cable 62. FIG. 1 also illustrates a second device 64 connected to the cassette 20 via a cable 66. The cassette 20 interconnects the first and second devices 60, 64. In an exemplary embodiment, the first device 60 may be a computer located remote from the cassette 20. The second device 64 may be a network switch. The second device 64 may be located in the vicinity of the cassette 20, such as in the same equipment room, or alternatively, may be located remote from the cassette 20. The cable interconnect system 10 may include a support structure 68, a portion of which is illustrated in FIG. 1, for supporting the panel 12 and the cassettes 20. For example, the support structure 68 may be an equipment rack of a network system. The panel 12 may be a patch panel that is mounted to the equipment rack. In alternative embodiments, rather than a patch panel, the panel 12 may be another type of network component used with a network system that supports cassettes 20 and/or other connector assemblies, such as interface modules, stacked jacks, or other individual modular jacks. For example, the panel 12 may be a wall or other structural element of a component. It is noted that the cable interconnect system 10 illustrated in FIG. 1 is merely illustrative of an exemplary system/component for interconnecting communication cables using modular jacks and modular plugs or other types of connectors. Optionally, the second device 64 may be mounted to the support structure 68.

Figure 2:
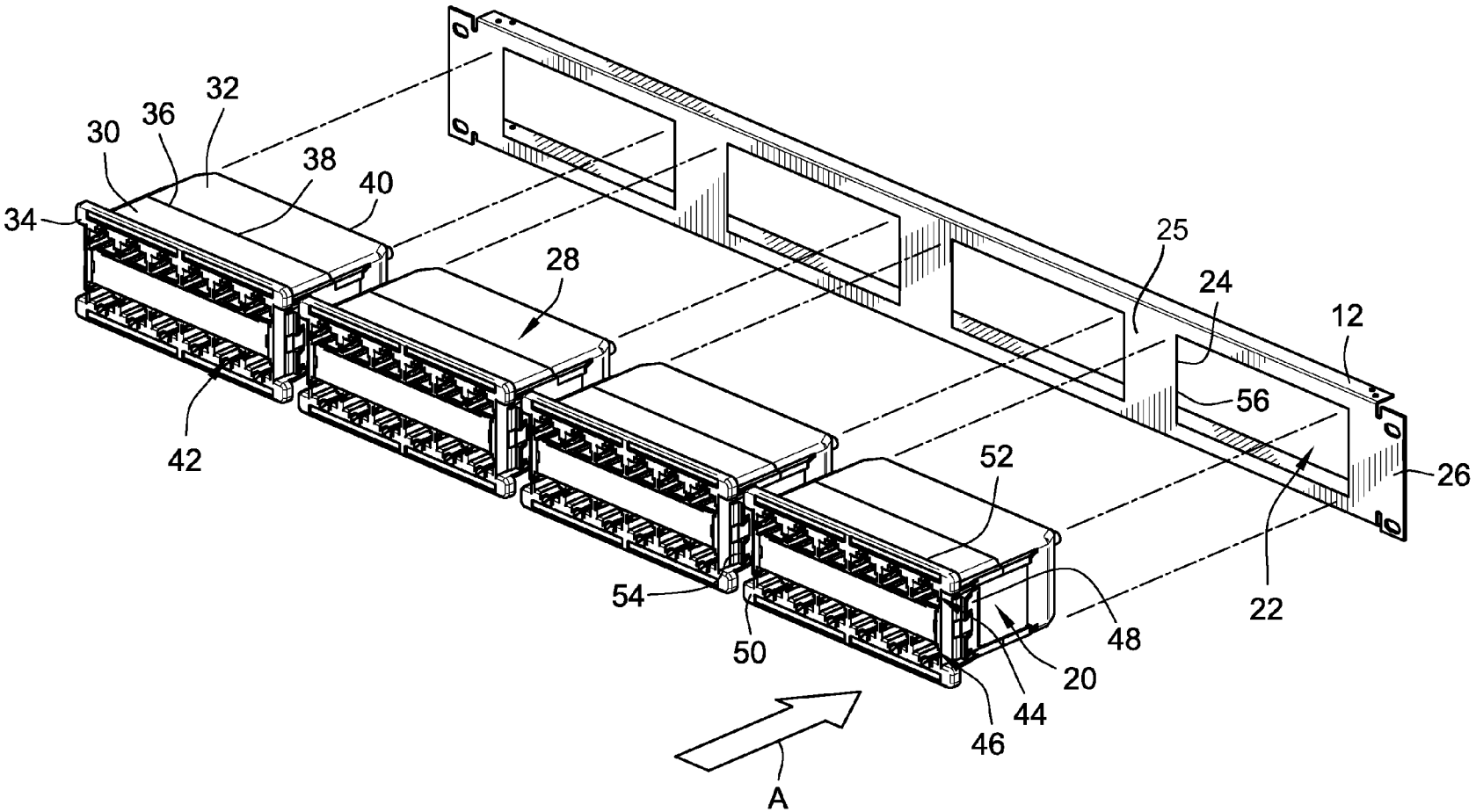
FIG. 2 is an exploded view of the panel and the cassettes illustrated in FIG. 1.

FIG. 2 is an exploded view of the panel 12 and the cassettes 20. The cassettes 20 are mounted within openings 22 of the panel 12. The openings 20 are defined by a perimeter wall 24. In an exemplary embodiment, the panel 12 includes a plurality of openings 22 for receiving a plurality of cassettes 20. The panel 12 includes a planar front surface 25, and the cassettes 20 are mounted against the front surface 25. The panel 12 includes mounting tabs 26 on the sides thereof for mounting to the support structure 68 (shown in FIG. 1). For example, the mounting tabs 26 may be provided at the sides of the panel 12 for mounting to a standard equipment rack or other cabinet system. Optionally, the panel 12 and mounting tabs 26 fit into 1 U height requirements.

The cassette 20 includes a shell 28 defining an outer perimeter of the cassette 20, in an exemplary embodiment, the shell 28 is a two piece design having a housing 30 and a cover 32 that may be coupled to the housing 30. The housing 30 and the cover 32 may have similar dimensions (e.g. height and width) to nest with one another to define a smooth outer surface. The housing 30 and the cover 32 may also have similar lengths, such that the housing 30 and the cover 32 mate approximately in the middle of the shell 28. Alternatively, the housing 30 may define substantially all of the shell 28 and the cover 32 may be substantially flat and be coupled to an end of the housing 30. Other alternative embodiments may not include the cover 32.

The housing 30 includes a front 34 and a rear 36. The cover 32 includes a front 38 and a rear 40. The front 34 of the housing 30 defines a front of the cassette 20 and the rear 40 of the cover 32 defines a rear of the cassette 20. In an exemplary embodiment, the cover 32 is coupled to the housing 30 such that the rear 36 of the housing 30 abuts against the front 38 of the cover 32.

The housing 30 includes a plurality of plug cavities 42 open at the front 34 of the housing 30 for receiving the modular plugs 14 (shown in FIG. 1). The plug cavities 42 define a portion of the receptacles 16, in an exemplary embodiment, the plug cavities 42 are arranged in a stacked configuration in a first row 44 and a second row 46 of plug cavities 42. A plurality of plug cavities 42 are arranged in each of the first and second rows 44, 46. In the illustrated embodiment, six plug cavities 42 are arranged in each of the first and second rows 44, 46, thus providing a total of twelve plug cavities 42 in each cassette 20. Four cassettes 20 are provided that are mounted to the panel 12, thus providing a total of forty-eight plug cavities 42. Such an arrangement provides forty-eight plug cavities 42 that receive forty-eight modular plugs 14 within the panel 12 that fits within 1 U height requirement. It is realized that the cassettes 20 may have more or less than twelve plug cavities 42 arranged in more or less than two rows of plug cavities 42. It is also realized that more or less than four cassettes 20 may be provided for mounting to the panel 12.

The cassette 20 includes latch members 48 on one or more sides of the cassette 20 for securing the cassette 20 to the panel 12. The latch members 48 may be held close to the sides of the cassette 20 to maintain a smaller form factor. Alternative mounting means may be utilized in alternative embodiments. The latch members 48 may be separately provided from the housing 30 and/or the cover 32. Alternatively, the latch members 48 may be integrally formed with the housing 30 and/or the cover 32.

During assembly, the cassettes 20 are loaded into the openings 22 of the panel 12 from the front of the panel 12, such as in the loading direction illustrated in FIG. 2 by an arrow A. The outer perimeter of the cassette 20 may be substantially similar to the size and shape of the perimeter walls 24 defining the openings 22 such that the cassette 20 fits snugly within the openings 22. The latch members 48 are used to secure the cassettes 20 to the panel 12. In an exemplary embodiment, the cassettes 20 include a front flange 50 at the front 34 of the housing 30. The front flanges 50 have a rear engagement surface 52 that engages the front surface 25 of the panel 12 and the cassette 20 is loaded into the openings 22. The latch members 48 include a panel engagement surface 54 that is forward facing such that, when the cassette 20 is loaded into the opening 22, the panel engagement surface 54 engages a rear 56 of the panel 12. The panel 12 is captured between the rear engagement surface 52 of the front flanges 50 and the panel engagement surface 54 of the latch members 48.

Figure 3:
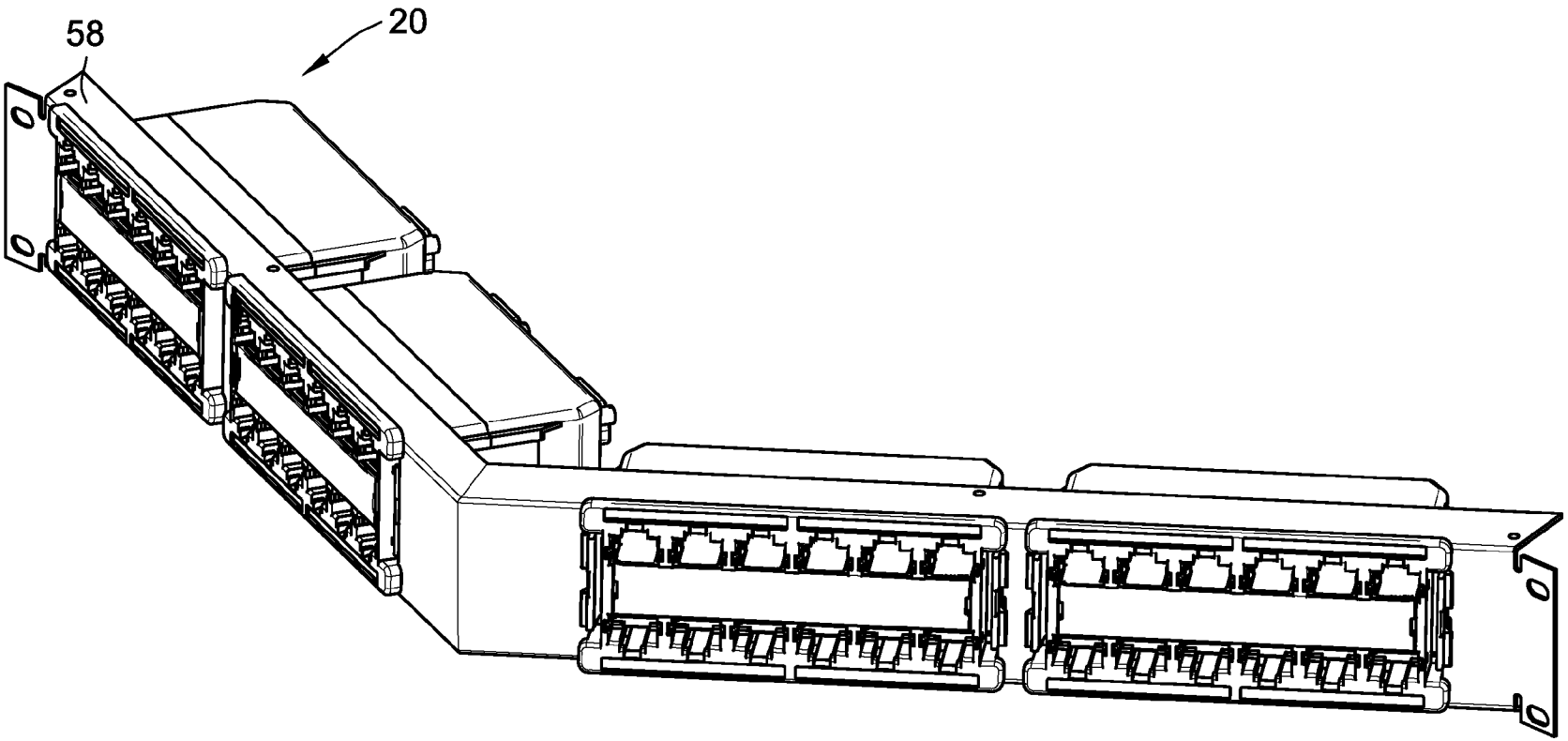
FIG. 3 is a front perspective view of an alternative panel for the cable interconnect system with cassettes mounted thereto.

FIG. 3 is a front perspective view of an alternative panel 58 for the cable interconnect system 10 with cassettes 20 mounted thereto. The panel 58 has a V-configuration such that the cassettes 20 are angled in different directions. Other panel configurations are possible in alternative embodiments. The cassettes 20 may be mounted to the panel 58 in a similar manner as the cassettes 20 are mounted to the panel 12 (shown in FIG. 1). The panel 58 may fit within 1 U height requirements.

Figure 4:
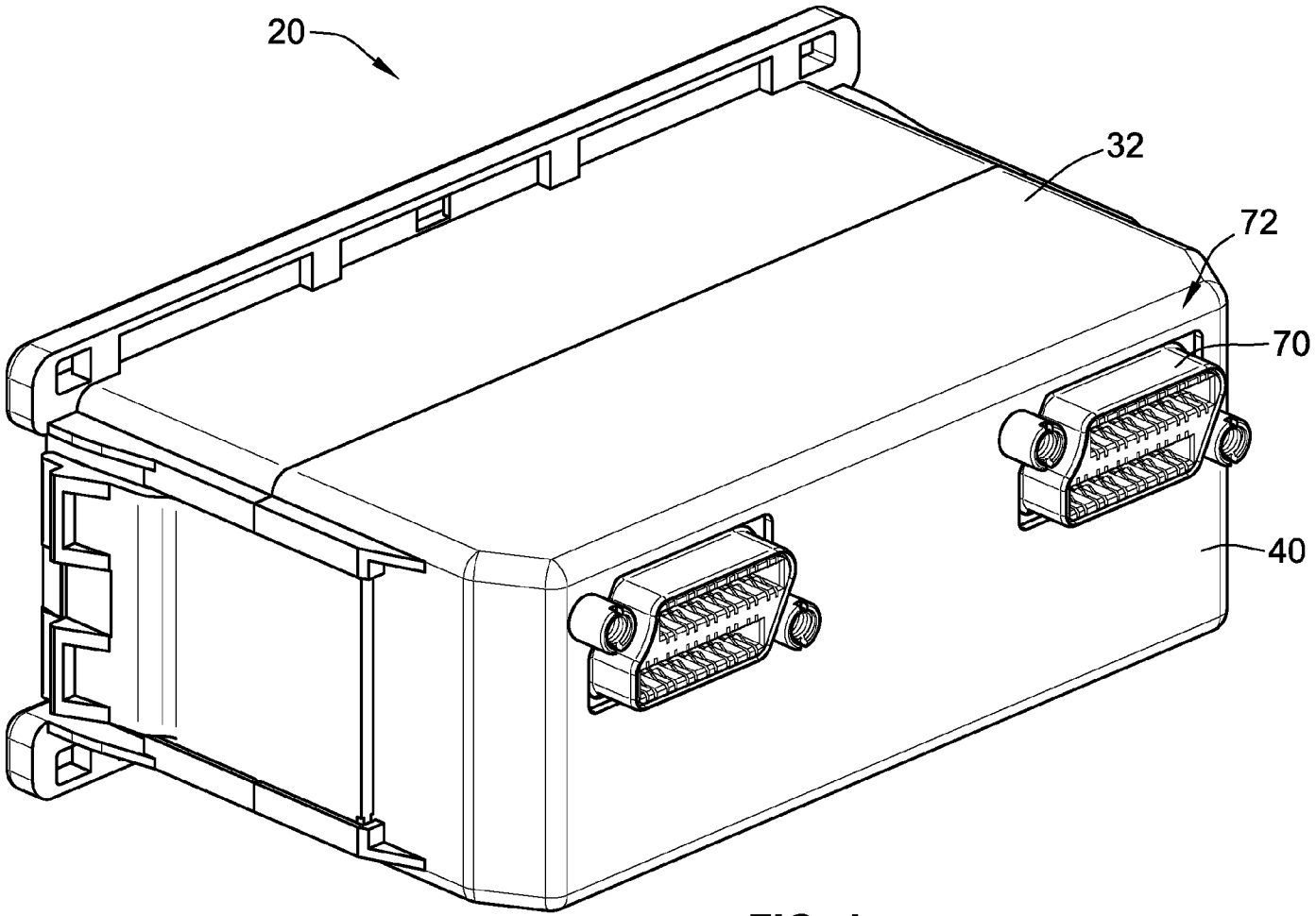
FIG. 4 is a rear perspective view of a cassette shown in FIG. 1.

FIG. 4 is a rear perspective view of one of the cassettes 20 illustrating a plurality of rear mating connectors 70. The rear mating connectors 70 are configured to mate with cable assemblies having a mating cable connector where the cable assemblies are routed to another device or component of the cable interconnect system 10 (shown in FIG. 1). For example, the cable connectors may be provided at ends of cables that are routed behind the panel 12 to a network switch or other network component. Optionally, a portion of the rear mating connectors 70 may extend through an opening 72 in the rear 40 of the cover 32. In the illustrated embodiment, the rear mating connectors 70 are represented by board mounted MRJ-21 connectors, however, it is realized that other types of connectors may be used rather than MRJ-21 type of connectors. For example, in alternative embodiments, the rear mating connectors 70 may be another type of copper-based modular connectors, fiber optic connectors or other types of connectors, such as eSATA connectors, HDMI connectors, USB connectors, FireWire connectors, and the like.

As will be described in further detail below, the rear mating connectors 70 are high density connectors, that is, each rear mating connector 70 is electrically connected to more than one of the receptacles 16 (shown in FIG. 1) to allow communication between multiple modular plugs 14 (shown in FIG. 1) and the cable connector that mates with the rear mating connector 70. The rear mating connectors 70 are electrically connected to more than one receptacles 16 to reduce the number of cable assemblies that interface with the rear of the cassette 20. It is realized that more or less than two rear mating connectors 70 may be provided in alternative embodiments.

Figure 5:
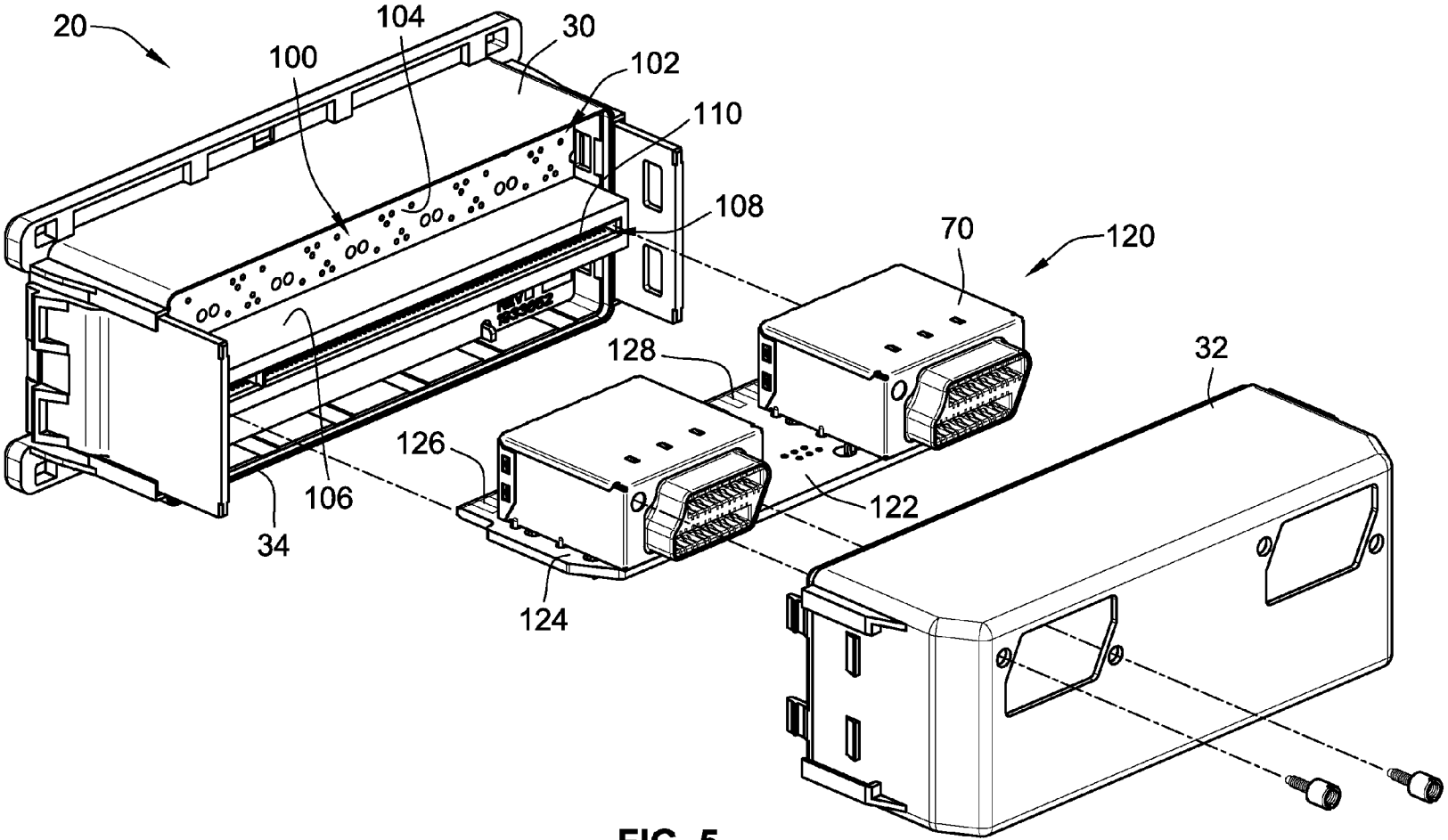
FIG. 5 is a rear exploded view of the cassette shown in FIG. 4.

FIG. 5 is a rear exploded view of the cassette 20 illustrating the cover 32 removed from the housing 30. The cassette 20 includes a contact subassembly 100 loaded into the housing 30. In an exemplary embodiment, the housing 30 includes a rear chamber 102 at the rear 36 thereof. The contact subassembly 100 is at least partially received in the rear chamber 102. The contact subassembly 100 includes a circuit board 104 and one or more electrical connectors 106 mounted to the circuit board 104. In an exemplary embodiment, the electrical connector 106 is a card edge connector. The electrical connector 106 includes at least one opening 108 and one or more contacts 110 within the opening 108. In the illustrated embodiment, the opening 108 is an elongated slot and a plurality of contacts 110 are arranged within the slot. The contacts 110 may be provided on one or both sides of the slot. The contacts 110 may be electrically connected to the circuit board 104.

The cassette 20 includes an interface connector assembly 120 that includes the rear mating connectors 70. The interface connector assembly 120 is configured to be mated with the electrical connector 106. In an exemplary embodiment, the interface connector assembly 120 includes a circuit board 122. The rear mating connectors 70 are mounted to a side surface 124 of the circuit board 122. In an exemplary embodiment, the circuit board 122 includes a plurality of edge contacts 126 along an edge 128 of the circuit board 122. The edge contacts 126 may be mated with the contacts 110 of the contact subassembly 100 by plugging the edge 128 of the circuit board 122 into the opening 108 of the electrical connector 106. The edge contacts 126 are electrically connected to the rear mating connectors 70 via the circuit board 122. For example, traces may be provided on or in the circuit board 122 that interconnect the edge contacts 126 with the rear mating connectors 70. The edge contacts 126 may be provided on one or more sides of the circuit board 122. The edge contacts 126 may be contact pads formed on the circuit board 122. Alternatively, the edge contacts 126 may extend from at least one of the surfaces and/or the edge 128 of the circuit board 122. In alternative embodiment, rather than using edge contacts 126, the interface connector assembly 120 may include an electrical connector at, or proximate to, the edge 128 for mating with the electrical connector 106 of the contact subassembly 100.

Figure 6:
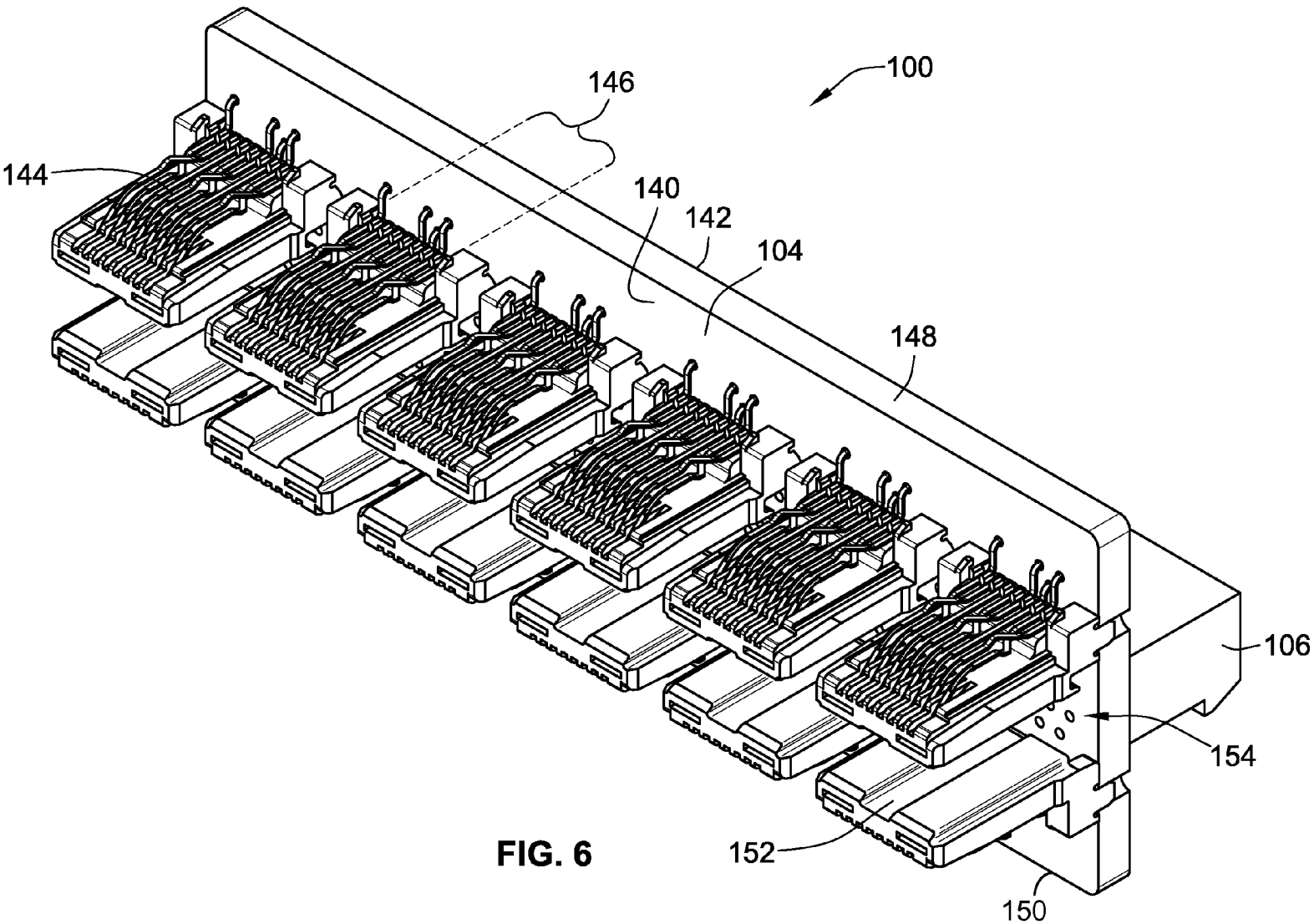
FIG. 6 illustrates a contact subassembly of the cassette shown in FIG. 4.

FIG. 6 illustrates, the contact subassembly 100 of the cassette 20 (shown in FIG. 4). The circuit board 104 of the contact subassembly 100 includes a front side 140 and a rear side 142. The electrical connector 106 is mounted to the rear side 142. A plurality of contacts 144 extend from the front side 140 of the circuit board 104. The contacts 144 are electrically connected to the circuit board 104 and are electrically connected to the electrical connector 106 via the circuit board 104.

The contacts 144 are arranged in contact sets 146 with each contact set 146 defining a portion of a different receptacle 16 (shown in FIG. 1). For example, in the illustrated embodiment, eight contacts 144 are configured as a contact array defining each of the contact sets 146. The contacts 144 may constitute a contact array that is configured to mate with plug contacts of an RJ-45 modular plug. The contacts 144 may have a different configuration for mating with a different type of plug in alternative embodiments. More or less than eight contacts 144 may be provided in alternative embodiments. In the illustrated embodiment, six contact sets 146 are arranged in each of two rows in a stacked configuration, thus providing a total of twelve contact sets 146 for the contact subassembly 100. Optionally, the contact sets 146 may be substantially aligned with one another within each of the rows and may be aligned above or below another contact set 146. For example, an upper contact set 146 may be positioned relatively closer to a top 148 of the circuit board 104 as compared to a lower contact set 146 which may be positioned relatively closer to a bottom 150 of the circuit board 104.

In an exemplary embodiment, the contact subassembly 100 includes a plurality of contact supports 152 extending from the front side 140 of the circuit board 104. The contact supports 152 are positioned in close proximity to respective contact sets 146. Optionally, each contact support 152 supports the contacts 144 of a different contact set 146. In the illustrated embodiment, two rows of contact supports 152 are provided. A gap 154 separates the contact supports 152. Optionally, the gap 154 may be substantially centered between the top 148 and the bottom 150 of the circuit board 104.

During assembly, the contact subassembly 100 is loaded into the housing 30 (shown in FIG. 2) such that the contact sets 146 and the contact supports 152 are loaded into corresponding plug cavities 42 (shown in FIG. 2). In an exemplary embodiment, a portion of the housing 30 extends between adjacent contact supports 152 within a row, and a portion of the housing 30 extends into the gap 154 between the contact supports 152.

Figure 7:
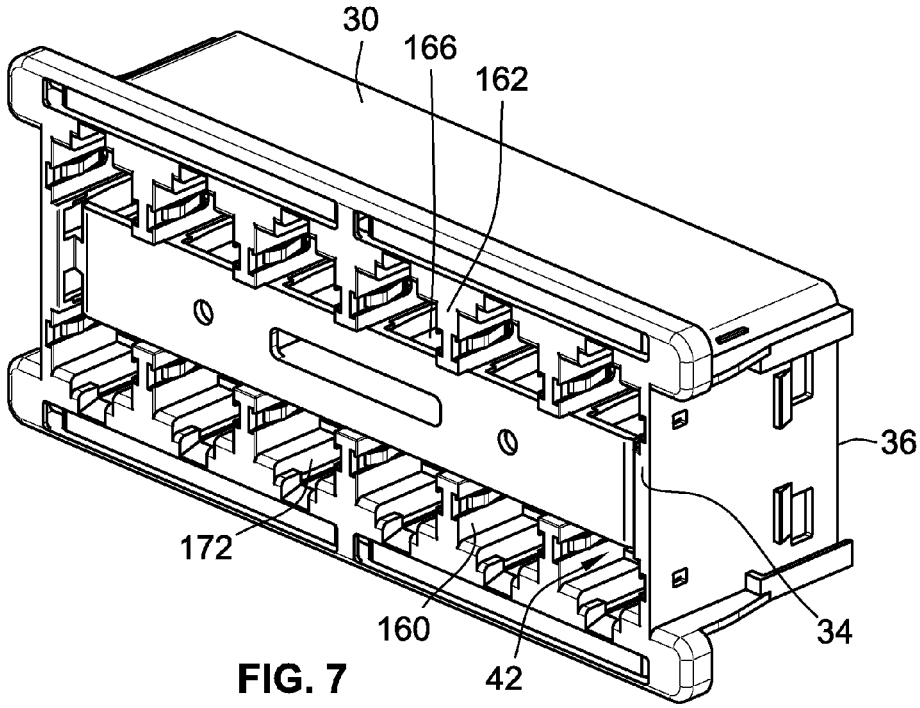
FIG. 7 is a front perspective view of a housing of the cassette shown in FIG. 4.
Figure 8:
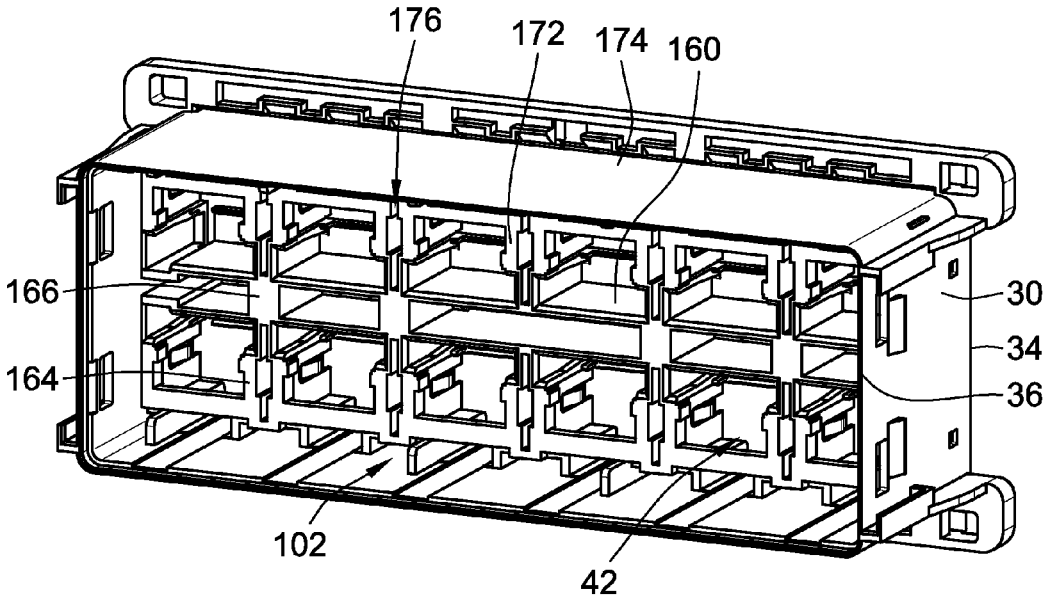
FIG. 8 is a rear perspective view of the housing shown in FIG. 7.

FIGS. 7 and 8 are front and rear perspective views, respectively, of the housing 30 of the cassette 20 (shown in FIG. 1). The housing 30 includes a plurality of interior walls 160 mat extend between adjacent plug cavities 42. The walls 160 may extend at least partially between the front 34 and the rear 36 of the housing 30. The walls 160 have a front surface 162 (shown in FIG. 7) and a rear surface 164 (shown in FIG. 8). Optionally, the front surface 162 may be positioned at, or proximate to, the front 34 of the housing 30. The rear surface 164 may be positioned remote with respect to, and/or recessed from, the rear 36 of the housing 30. The housing 30 includes a tongue 166 represented by one of the walls 160 extending between the first and second rows 44, 46 of plug cavities 42. Optionally, the interior walls 160 may be formed integral with the housing 30.

In an exemplary embodiment, the housing 30 includes a rear chamber 102 (shown in FIG. 8) at the rear 36 of the housing 30. The rear chamber 102 is open to each of the plug cavities 42. Optionally, the rear chamber 102 extends from the rear 36 of the housing 30 to the rear surfaces 164 of the walls 160. The rear chamber 102 is open at the rear 36 of the housing 30. In the illustrated embodiment, the rear chamber 102 is generally box-shaped, however the rear chamber 102 may have any other shape depending on the particular application and/or the size and shape of the components filing the rear chamber 102.

In an exemplary embodiment, the plug cavities 42 are separated from adjacent plug cavities 42 by shield elements 172. The shield, elements 172 may be defined by the interior walls 160 and/or exterior walls 174 of the housing 30. For example, the housing 30 may be fabricated from a metal material with the interior walls 160 and/or the exterior walls 174 also fabricated, from the metal material. In an exemplary embodiment, the housing 30 is diecast using a metal or metal alloy, such as aluminum or an aluminum alloy. With the entire housing 30 being metal, the housing 30, including the portion of the housing 30 between the plug cavities 42 (e.g. the interior walls 160) and the portion of the housing 30 covering the plug cavities 42 (e.g. the exterior walls 174), operates to provide shielding around the plug cavities 42. In such an embodiment the housing 30 itself defines the shield elements(s) 172. The plug cavities 42 may be completely enclosed (e.g. circumferentially surrounded) by the shield elements 172.

With each contact set 146 (shown, in FIG. 6) arranged within a different plug cavity 42, the shield elements 172 provide shielding between adjacent contact sets 146. The shield elements 172 thus provide isolation between the adjacent contact sets 146 to enhance the electrical performance of the contact sets 146 received in each plug cavity 42. Having shield elements 172 between adjacent plug cavities 42 provides better shield effectiveness for the cable interconnect system 10 (shown in FIG. 1), which may enhance electrical performance in systems that utilize components that do not provide shielding between adjacent plug cavities 42. For example, having shield elements 172 between adjacent plug cavities 42 within a given row 44, 46 enhances electrical performance of the contact sets 146. Additionally, having shield elements 172 between the rows 44, 46 of plug cavities 42 may enhance the electrical performance of the contact sets 146. The shield elements 172 may reduce alien crosstalk between adjacent contact sets 146 in a particular cassette and/or reduce alien crosstalk with contact sets 146 of different cassettes 20 or other electrical components in the vicinity of the cassette 20. The shield elements may also enhance electrical performance of the cassette 20 in other ways, such as by providing EMI shielding or by affecting coupling attenuation, and the like.

In an alternative embodiment, rather than the housing 30 being fabricated from a metal material, the housing 30 may be fabricated, at least in part, from a dielectric material. Optionally, the housing 30 may be selectively metallized, with the metallized portions defining the shield elements 172. For example, at least a portion of the housing 30 between the plug cavities 42 may be metallized to define the shield elements 172 between the plug cavities 42. Portions of the interior walls 160 and/or the exterior walls 174 may be metallized. The metallized surfaces define the shield elements 172. As such, the shield elements 172 are provided on the interior walls 160 and/or the exterior walls 174. Alternatively, the shield elements 172 may be provided on the interior walls 160 and/or the exterior walls 174 in a different manner, such as by plating or by coupling separate shield elements 172 to the interior walls 160 and/or the exterior walls 174. The shield elements 172 may be arranged along the surfaces defining the plug cavities 42 such that at least some of the shield elements 172 engage the modular plugs 14 when the modular plugs 14 are loaded into the plug cavities 42. In other alternative embodiments, the walls 160 and/or 174 may be formed, at least in part, by metal filler materials provided within or on the walls 160 and/or 174 or metal fibers provided within or on the walls 160 and/or 174.

In another alternative embodiment, rather than, or in addition to, providing the shield elements 172 on the walls of the housing 30, the shield elements 172 may be provided within the walls of the housing 30. For example, the interior walls 160 and/or the exterior walls 174 may include openings 176 that are open at the rear 36 and/or the front 34 such that the shield elements 172 may be loaded into the openings 176. The shield elements 172 may be separate metal components, such as plates, that are loaded into the openings 176. The openings 176, and thus the shield elements 172, are positioned between the plug cavities 42 to provide shielding between adjacent contact sets 146.

Figure 9:
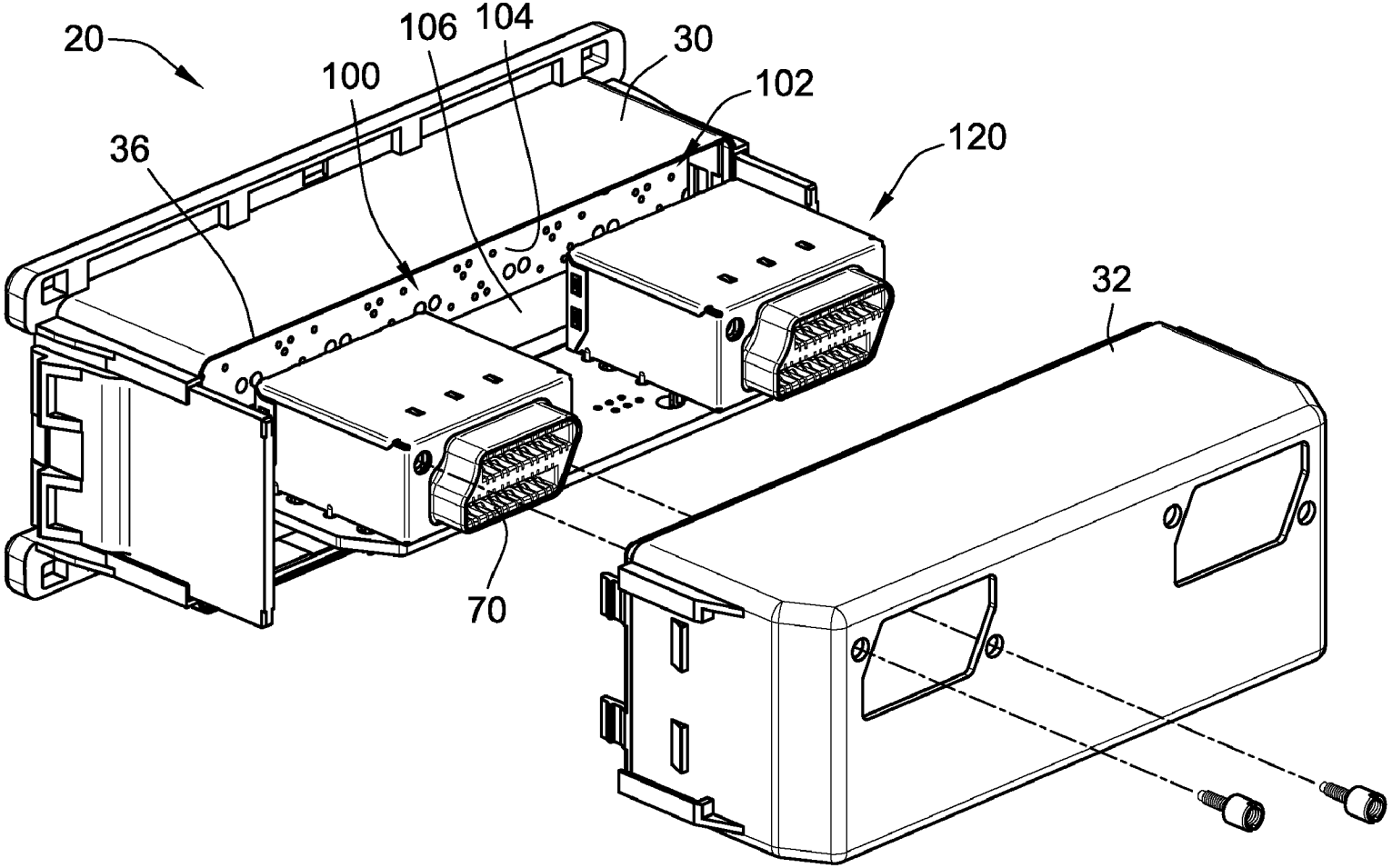
FIG. 9 is a rear perspective view of the cassette shown in FIG. 4 during assembly.

FIG. 9 is a rear perspective, partially assembled, view of the cassette 20. During assembly, the contact subassembly 100 is loaded into the rear chamber 102 of the housing 30 through the rear 36. Optionally, the circuit board 104 may substantially fill the rear chamber 102. The contact subassembly 100 is loaded into the rear chamber 102 such that the electrical connector 106 faces the rear 36 of the housing 30. The electrical connector 106 may beat least partially received in the rear chamber 102 and at least a portion of the electrical connector 106 may extend from the rear chamber 102 beyond the rear 36.

During assembly, the interface connector assembly 120 is mated with the electrical connector 106. Optionally, the interface connector assembly 120 may be mated with the electrical connector 106 after the contact subassembly 100 is loaded into the housing 30. Alternatively, both the contact subassembly 100 and the interface connector assembly 120 may be loaded into the housing 30 as a unit. Optionally, some or all of the interface connector assembly 120 may be positioned rearward of the housing 30.

The cover 32 is coupled to the housing 30 after the contact subassembly 100 and the interface connector assembly 120 are positioned with respect to the housing 30. The cover 32 is coupled to the housing 30 such that the cover 32 surrounds the interface connector assembly 120 and/or the contact subassembly 100. In an exemplary embodiment, when the cover 32 and the housing 30 are coupled together, the cover 32 and the housing 30 cooperate to define an inner chamber 170 (shown in FIGS. 10 and 11). The rear chamber 102 of the housing 30 defines part of the inner chamber 170, with the hollow interior of the cover 32 defining another part of the inner chamber 170. The interface connector assembly 120 and the contact subassembly 100 are received in the inner chamber 170 and protected from the external environment by the cover 32 and the housing 30. Optionally, the cover 32 and the housing 30 may provide shielding for the components housed within the inner chamber 170. The rear mating connectors 70 may extend through the cover 32 when the cover 32 is coupled to the housing 30. As such, the rear mating connectors 70 may extend at least partially out of the inner chamber 170.

Figure 10:
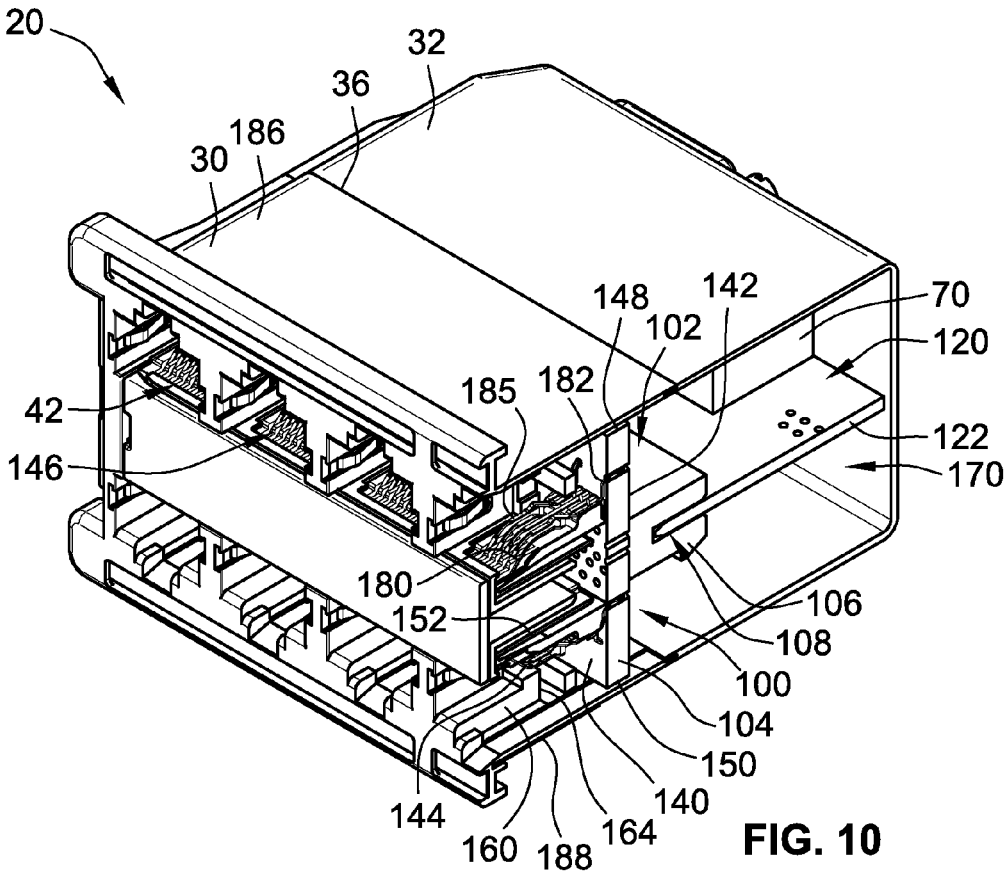
FIG. 10 is a side perspective, partial cutaway view of the cassette shown in FIG. 4.
Figure 11:
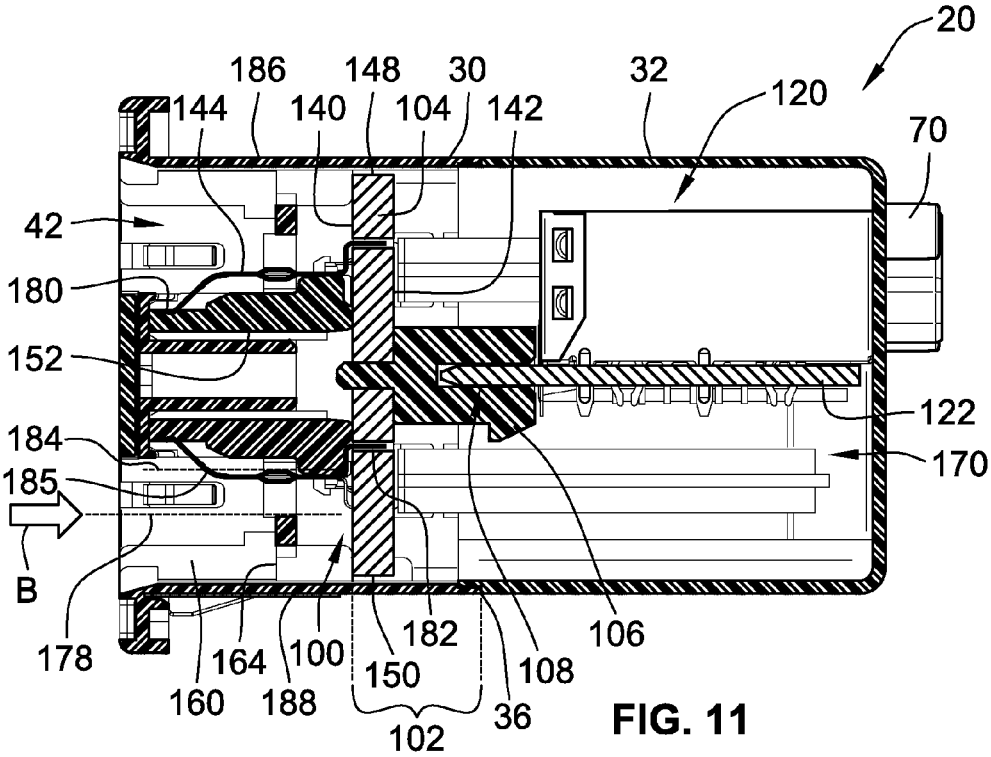
FIG. 11 is a cross-sectional view of the cassette shown in FIG. 4.

FIG. 10 is a side perspective, partial cutaway view of the cassette 20 and FIG. 11 is a cross-sectional view of the cassette 20. FIGS. 10 and 11 illustrate the contact subassembly 100 and the interface connector assembly 120 positioned within the inner chamber 170, with the cover 32 coupled to the housing 30. The contact subassembly 100 is loaded into the rear chamber 102 such that the front side 140 of the circuit board 104 generally faces and/or abuts against the rear surfaces 164 of the walls 160. Optionally, the front side 140 may abut against a structure of the housing 30, such as the rear surfaces 164 of the walls 160, or alternatively, a rib or tab that extends from the housing 30 for locating the contact subassembly 100 within the housing 30. When the contact subassembly 100 is loaded into the rear chamber 102, the contacts 144 and the contact supports 152 are loaded into corresponding plug cavities 42.

When assembled, the plug cavities 42 and the contact sets 146 cooperate to define the receptacles 16 for mating with, the modular plugs 14 (shown in FIG. 1). The walls 160 of the housing 30 define the walls of the receptacles 16 and the modular plugs 14 engage the walls 160 when the modular plugs 14 are loaded into the plug cavities 42. The contacts 144 ate presented within the plug cavities 42 for mating with plug contacts of the modular pings 14. In an exemplary embodiment, when the contact subassembly 100 is loaded into the housing 30, the contact supports 152 are exposed within the plug cavities 42 and define one side of the box-like cavities that define the plug cavities 42.

Each of the contacts 144 extend, between a tip 180 and a base 182 generally along a contact plane 184 (shown in FIG. 11). A portion of the contact 144 between the tip 180 and the base 182 defines a mating interface 185. The contact plane 184 extends parallel to the modular plug loading direction, shown in FIG. 11 by the arrow 8, which extends generally along a plug axis 178. Optionally, the tip 180 may be angled out of the contact plane 184 such that the tips 180 do not interfere with the modular plug 14 during loading of modular plug 14 into the plug cavity 42. The tips 180 may be angled towards and/or engage the contact supports 152. Optionally, the bases 182 may be angled out of the contact plane 184 such that the bases 182 may be terminated to the circuit board 104 at a predetermined location. The contacts 144, including the tips 180 and the bases 182, may be oriented with respect to one another to control electrical properties therebetween, such as crosstalk. In an exemplary embodiment, each of the tips 180 within the contact set 146 are generally aligned one another. The bases 182 of adjacent contacts 144 may extend either in the same direction or in a different direction as one another. For example, at least some of the bases 182 extend towards the top 148 of the circuit board 104, whereas some of the bases 182 extend towards the bottom of 150 of the circuit board 104.

In an exemplary embodiment, the circuit board 104 is generally perpendicular to the contact plane 184 and the plug axis 178. The top 148 of the circuit board 104 is positioned near a top side 186 of the housing 30, whereas the bottom 150 of the circuit board 104 is positioned near a bottom side 188 of the housing 30. The circuit board 104 is positioned generally behind the contacts 144, such as between the contacts 144 and the rear 36 of the housing 30. The circuit board 104 substantially covers the rear of each of the plug cavities 42 when the connector subassembly 100 is loaded into the rear chamber 102. In an exemplary embodiment, the circuit board 104 is positioned essentially equidistant from the mating interface 185 of each of the contacts 144. As such, the contact length between the mating interface 185 and the circuit hoard 104 is substantially similar for each of the contacts 144. Each of the contacts 144 may thus exhibit similar electrical characteristics. Optionally, the contact length may be selected such mat the distance between a mating interface 185 and the circuit board 104 is reasonably short. Additionally, the contact lengths of the contacts 144 in the upper row 44 (shown in FIG. 2) of plug cavities 42 are substantially similar to the contact lengths of the contacts 144 in the lower row 46 (shown in FIG. 2) of plug cavities 42.

The electrical connector 106 is provided on the rear side 142 of the circuit board 104. The electrical connector 106 is electrically connected to the contacts 144 of one or more of the contacts sets 146. The interface connector assembly 120 is mated with the electrical connector 106. For example, the circuit board 122 of the interface connector assembly 120 is loaded into the opening 108 of the electrical connector 106. The rear mating connectors 70, which are mounted to the circuit board 122, are electrically connected to predetermined contacts 144 of the contacts sets 146 via the circuit board 122, the electrical connector 106 and the circuit board 104. Other configurations are possible to interconnect the rear mating connectors 70 with the contacts 44 of the receptacles 16.

Figure 12:
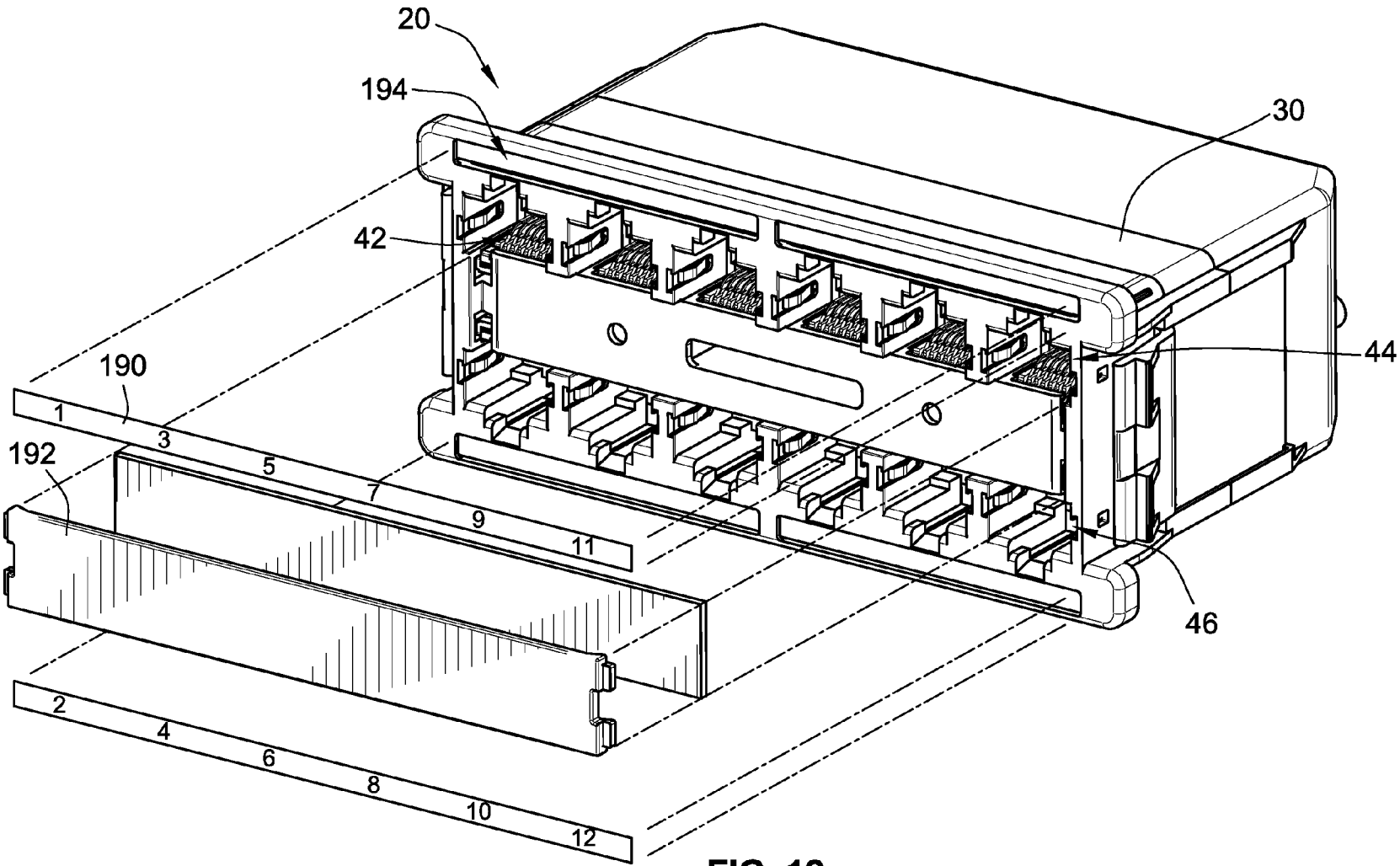
FIG. 12 is an exploded front perspective view of the cassette shown in FIG. 4 illustrating an exemplary embodiment of labels used with the cassette.

FIG. 12 is an exploded front perspective view of the cassette 20 illustrating label bands 190 and a label holder 192 for the cassette 20. In the illustrated embodiment, the label bands 190 are labels that have preprinted port identifiers that identify each of the plug cavities 42, such as with a number. The cassette 20 includes slots 194 that receives the label bands 190. Optionally, the cassette 20 may include one or more slots above the upper or first row 44 of plug cavities 42 and one or more slots below the lower or second row 46 of plug cavities 42. Portions of the label bands 190 are captured behind walls of the housing 30 to retain the label bands 190 within the slots 194.

The label holder 192 is removably coupled to the housing 30. Optionally, the label holder 192 may be positioned between the first and second rows 44, 46 of plug cavities 42. The configuration of the cassette 20 allows for a space that can receive the label holder 192. The label holder 192 may hold a label adjacent to the plug cavities 42. Identifying indicia may be presented on the label identifying particular ones of the plug cavities 42. Optionally, the label may be removed and discarded and replaced by different label with different indicia. The label holder 192 may then be replaced to hold a new label. Optionally, the label holder 192 may be clear such that, when the label is positioned behind the label holder 192, the label may be seen.

The label bands 190 and label holder 192 allow for removable/replaceable labeling of the cassette 20, in contrast to tradition silk screening of sheet metal parts which does not allow for relabeling. The pockets in the housing 30 accept the label bands 190 and the label holder easily and securely hold the label bands 190 and the label holder 192 therein.

A cassette 20 is thus provided that may be mounted to a panel 12 through an opening 22 in the panel 12. The cassette 20 includes a plurality of receptacles 16 that are configured to receive modular plugs 14 therein. The cassette 20 includes a contact subassembly 100 and an interface connector assembly 120. The contact subassembly 100 is loaded into a housing 30 and the contact subassembly 100 and interface connector assembly 120 are surrounded by the housing 30 and/or a cover 32. The contact subassembly 100 includes contacts 144 that are arranged in contact sets 146 that are loaded into plug cavities 42 defined by the housing 30 when the contact subassembly 100 is loaded into a rear chamber 102 of the housing 30. Walls 160 of the housing 30 define the plug cavities 42 such that the housing 30 defines more than one receptacles 16. The contact subassembly 100 includes a circuit board 104 that provides an interface between the contacts 144 and an electrical connector 106 which is mated with the interface connector assembly 120. The circuit board 104 is positioned generally behind each of the contacts 144 such that the contacts 144 of each of the contacts sets 146 generally have an equal contact length. Optionally, the circuit board 104 may be positioned generally equidistant from a mating interface 185 of each of the contacts 144 with the modular plugs 14.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in, means—plus-function format and are not intended to be interpreted based on 35 U.S.C. §112, sixth paragraph, unless and until such claim limitations expressly use the phrase "means for" followed by a statement of function void of further structure.

What is claimed is:

1. A cassette comprising:

a shell comprising a housing and a cover mated together to define an inner chamber bounded by the housing and the cover, the housing having a front and a rear with the cover coupled to the rear, the housing defining a front mating interface for mating with plugs, the housing having a plurality of plug cavities open at the front for receiving the plugs therein, the housing having a rear chamber open to the plug cavities, the shell defining a rear mating interface for mating with a mating plug;

a contact subassembly having a circuit board and a plurality of contacts arranged in contact sets coupled to the circuit board, each contact set being configured to mate with a corresponding plug, the contact subassembly being loaded into the rear chamber such that the contact sets are received in different corresponding plug cavities, the circuit board being oriented generally parallel to the front of the housing when the contact subassembly is loaded into the rear chamber; and a rear mating connector held within the shell, the rear mating connector defining the rear mating interface and being configured to receive the mating plug, the rear mating connector being positioned rearward of the circuit board, the rear mating connector being electrically connected to one or more of the contact sets via the circuit board.

2. The cassette of claim 1, wherein the circuit board is positioned behind each of the contact sets generally between the contact sets and the rear of the housing.

3. The cassette of claim 1, wherein the contacts extend into plug cavities generally along a plug axis extending in a direction in which the plug is loaded into the plug cavities, the circuit board being oriented generally perpendicular to the plug axis.

4. The cassette of claim 1, wherein the circuit board has a front side and a rear side, the contacts extend from the front side, the contact subassembly has at least one electrical connector mounted to the rear side of the circuit board that is electrically connected to the contacts of one or more of the contact sets, the rear mating connector being electrically connected to the corresponding contact set or contact sets via the electrical connector.

5. The cassette of claim 1, wherein the contact subassembly includes a plurality of contact supports extending from the circuit board in close proximity to respective contact sets, each contact support is configured to support the contacts of the corresponding contact set, the contact supports being received in different plug cavities when the contact subassembly is loaded into the rear chamber.

6. The cassette of claim 5, wherein each contact support cooperates with walls of the housing defining the corresponding plug cavity to form a box-like cavity around the contacts, the contact support defining one side of the box-like cavity.

7. The cassette of claim 1, wherein the housing has a plurality of walls positioned between adjacent plug cavities, the walls are configured to engage the plugs when the plugs are loaded into the plug cavities.

8. The cassette of claim 1, wherein the housing includes a removable label holder at the front of the housing and a label held by the label holder, the label having indicia thereon.

9. The cassette of claim 1, wherein the circuit board has a front side and a rear side, the contacts extend from the front side, the contact subassembly has a card edge connector mounted to the rear side of the circuit board, the rear mating connector being mounted to a second circuit board, the second circuit board being received in the card edge connector in a loading direction that is generally perpendicular to the front of the housing to electrically connect the rear mating connector and the corresponding contact set or contact sets.

10. A cassette comprising:

a housing having a front and a rear, the housing having plug cavities arranged in a stacked configuration in a first row and a second row with a plurality of plug cavities in the first row and a plurality of plug cavities in the second row, the plug cavities being open at the front for receiving plugs therein, the housing having a rear chamber open to the plug cavities; and a contact subassembly having a circuit board and a plurality of contacts arranged in contact sets coupled to the circuit board, each contact set being configured to mate with a corresponding plug, the contact subassembly being loaded into the rear chamber such that the contact sets are received in different corresponding plug cavities, wherein the contacts of the contact sets received in the first row of plug cavities have a substantially similar contact length as the contacts of the contact sets received in the second row of plug cavities wherein the contact subassembly includes a plurality of contact supports extending from the circuit board in close proximity to respective contact sets, each contact support is configured to support the contacts of the corresponding contact set, the contact supports being received in different plug cavities when the contact subassembly is loaded into the rear chamber.

11. The cassette of claim 10, wherein each plug cavity is open at a rear thereof to the rear chamber, the circuit board substantially covers the rear of each of the plug cavities when the contact subassembly is loaded into the rear chamber.

12. The cassette of claim 10, wherein the circuit board has a front side and a rear side, the contacts extend from the front side, the contact subassembly has at least one electrical connector mounted to the rear side of the circuit board that is electrically connected to the contacts of one or more of the contact sets.

13. The cassette of claim 10, wherein the housing has a tongue extending between first and second rows of plug cavities, the tongue is positioned between contacts of different contract sets.

14. The cassette of claim 10, wherein the housing has a plurality of walls positioned between adjacent plug cavities, the walls are configured to engage the plugs when the plugs are loaded into the plug cavities.

15. The cassette of claim 10, further comprising a rear mating connector defining a rear mating interface being configured to receive a mating plug, the rear mating connector being positioned rearward of the circuit board, the rear mating connector being electrically connected to one or more of the contact sets via the circuit board.

16. The cassette of claim 10, wherein the contact subassembly has a card edge connector mounted to a rear side of the circuit board, the cassette further comprising:

a shell comprising the housing and a cover coupled to the rear of the housing to define an inner chamber bounded by the housing and the cover, the housing defining a front mating interface for mating with the plugs, the shell defining a rear mating interface for mating with a mating plug; and a rear mating connector mounted to a second circuit board and held within the shell, the rear mating connector defining the rear mating interface and being configured to receive the mating plug, the rear mating connector being positioned rearward of the circuit board, the second circuit board being received in the card edge connector in a loading direction that is generally perpendicular to the front of the housing to electrically connect the rear mating connector with one or more of the contact sets.

17. The cassette of claim 10, wherein the housing includes twelve plug cavities with six plug cavities in the first row and six plug cavities in the second row, the housing being configured to fit within and be mechanically coupled to a panel, the housing being configured to fit within a 1U panel configuration.

18. A cable interconnect system incorporating a plurality of the cassettes of claim 17, wherein the housings are sized such that four cassettes are configured to fit within a 1U panel configuration.

19. A cable interconnect system comprising:

a panel having a module opening; and a cassette received in the module opening, the cassette comprising:

a shell comprising a housing and a cover mated together to define an inner chamber bounded by the housing and the cover, the housing having a front and a rear with the cover coupled to the rear, the housing defining a front mating interface for mating with plugs, the housing having a plurality of plug cavities open at the front for receiving the plugs therein, the housing having a rear chamber open to the plug cavities, the shell defining a rear mating interface for mating with a mating plug;

a contact subassembly having a circuit board and a plurality of contacts arranged in contact sets coupled to the circuit board, each contact set being configured to mate with a corresponding plug, the contact subassembly being loaded into the rear chamber such that the contact sets are received in different corresponding plug cavities, the circuit board being oriented generally parallel to the front of the housing when the contact subassembly is loaded into the rear chamber; and a rear mating connector held within the shell, the rear mating connector defining the rear mating interface and being configured to receive the mating plug, the rear mating connector being positioned rearward of the circuit board, the rear mating connector being electrically connected to one or more of the contact sets via the circuit board.

20. The cable interconnect system of claim 19, wherein the panel is configured to fit within a 1U panel configuration.

21. The cable interconnect system of claim 19, wherein the cassette has twelve plug cavities and corresponding contact sets, and wherein the panel has four module openings configured to receive four cassettes.

* * * * *